United States Patent [19]

Haubrich et al.

[11] 4,365,901

[45] Dec. 28, 1982

[54] MATRIX PRINTER WITH AUTOMATIC PRINTING HEAD ADJUSTMENT

[75] Inventors: Lothar Haubrich, Siegen; Heinrich Dürr, Wilnsdorf, both of Fed. Rep. of Germany

[73] Assignee: U.S. Philips Corporation, New York, N.Y.

[21] Appl. No.: 266,570

[22] Filed: May 22, 1981

[30] Foreign Application Priority Data

May 22, 1980 [DE] Fed. Rep. of Germany ..... 3019515

[51] Int. Cl.[3] ..... B41J 3/12

[52] U.S. Cl. ..... 400/124; 101/93.05

[58] Field of Search ..... 400/121, 124; 101/93.04, 93.05

[56] References Cited

U.S. PATENT DOCUMENTS 4,010,835 3/1977 Martin et al. ..... 400/124

FOREIGN PATENT DOCUMENTS 2535699 3/1977 Fed. Rep. of Germany ..... 400/124

*Primary Examiner*—Paul T. Sewell

*Attorney, Agent, or Firm*—James J. Cannon, Jr.

[57] ABSTRACT

A matrix printer with a printing head which is displaceable along a paper guide in the line direction and which has a number of printing elements which have a first printing position for printing from left to right and a second printing position for printing from right to left. The printing head with its printing elements is automatically moved from the one printing position to the other printing position by variation of the impulse of movement of the printing head upon each movement reversal of the printing head by means of a position changer which is displaceable with respect to the printing head.

5 Claims, 5 Drawing Figures

MATRIX PRINTER WITH AUTOMATIC PRINTING HEAD ADJUSTMENT

BACKGROUND OF THE INVENTION

1. Field of the Invention

The invention relates to a matrix printer comprising a combination of a carriage and a printing head which is mounted thereon, said combination being movable to and fro along a paper guide, said printing head having a first printing position for printing character elements during a pass from left to right and a second printing position for printing character elements during a pass from right to left, the character elements of a given printing element in the printing head printed on the paper during the movement of the printing head to the right being displaced over a distance which amounts to a part of the vertical distance between two successive printing elements in the printing head with respect to the character elements of the same printing element printed on the paper during the movement to the left.

2. Description of the Prior Art

In a known matrix printer of the kind set forth (U.S. Pat. No. 4,086,997), the height of the printing head with respect to the paper guide is adjusted by actuation of an electromagnet whose armature is connected, via a lever, to an eccentric, which cooperates with a part of the longitudinal guide of the carriage. The height adjustment of the printing head is realized by pivoting of the printing head about an axis which extends parallel to the line direction. Because the height of the printing head can be adjusted as desired, a choice is possible between characters whose constituent elements (dots) are situated comparatively far apart and characters whose constituent elements are situated comparatively near to one another or which even overlap one another.

For many applications, however, it is necessary that the constituent elements of the printed character are always situated comparatively near to one another or overlap one another. This is the case, for example, in so-called text editing machines. Even though an electromagnetic height adjustment of the printing head could be used in such applications, a height adjustment of this kind is comparatively expensive because the facility offered is greater than required, i.e. adjustment as desired.

SUMMARY OF THE INVENTION

It is an object of the invention to provide a matrix printer of the kind set forth whereby characters whose constituent elements are situated comparatively near one another can be simply fully automatically printed, while using only a comparatively small number of printing elements.

A matrix printer in accordance with the invention is characterized in that the combination formed by the carriage and the printing head comprises a chamber in which there is arranged a position changer which can be displaced relative to said combination by a variation of the impulse of movement of the printing head, the printing head being in the one printing position before the impulse variation and in the other printing position after the impulse variation.

Because use is made of a variation of the impulse of movement (product of mass and velocity vector) of the printing head which always occurs near the beginning or the end of a line where the movement direction of the printing head is reversed, automatic height adjustment of the printing head is obtained without utilizing comparatively expensive means such as electromagnets. It may be stated in general that the path segment in which the height adjustment is realized may be situated before or after the reversal point as well as on either side thereof (viewed in time). It is particularly simple and advantageous to utilize the movement reversal itself, (fully or to a substantial degree) for the height adjustment, without having to use given mass inertia forces on the position changer. The variation of the impulse of movement is in that case given by the direction reversal of the velocity vector.

In a special embodiment of a matrix printer in accordance with the invention, the position changer constitutes the coupling between the printing head and a friction plate which is slidable on a guide wall which bounds the chamber. The use of a separate friction plate as a coupling offers the advantage that various kinds of position changers can be used for the same friction conditions between friction plate and guide wall, because the friction element is standardized as if it were. Furthermore, it is also possible to obtain a very specific friction coefficient for a comparatively long period of time by the choice of the material of the friction plate. Moreover, the friction plate can also be used for determining the extent of the relative movement performed by the position changer with respect to the printing head.

A further special embodiment of a matrix printer in accordance with the invention is characterized in that the chamber is provided within the carriage, the guide wall bounding the chamber forming part of a stationary guide profile which extends parallel to the line direction, the printing head and the carriage being pivotable with respect to the guide profile from the first printing position to the second printing position and vice versa about a pivot axis which extends perpendicularly to the line direction. Because the carriage is pivotable together with the printing head, the guide profile of the carriage already present can be used for guiding the pivoting motion.

The invention will be described in detail hereinafter with reference to the accompanying diagrammatic drawing.

DESCRIPTION OF THE PREFERRED EMBODIMENTS

Figure 1:
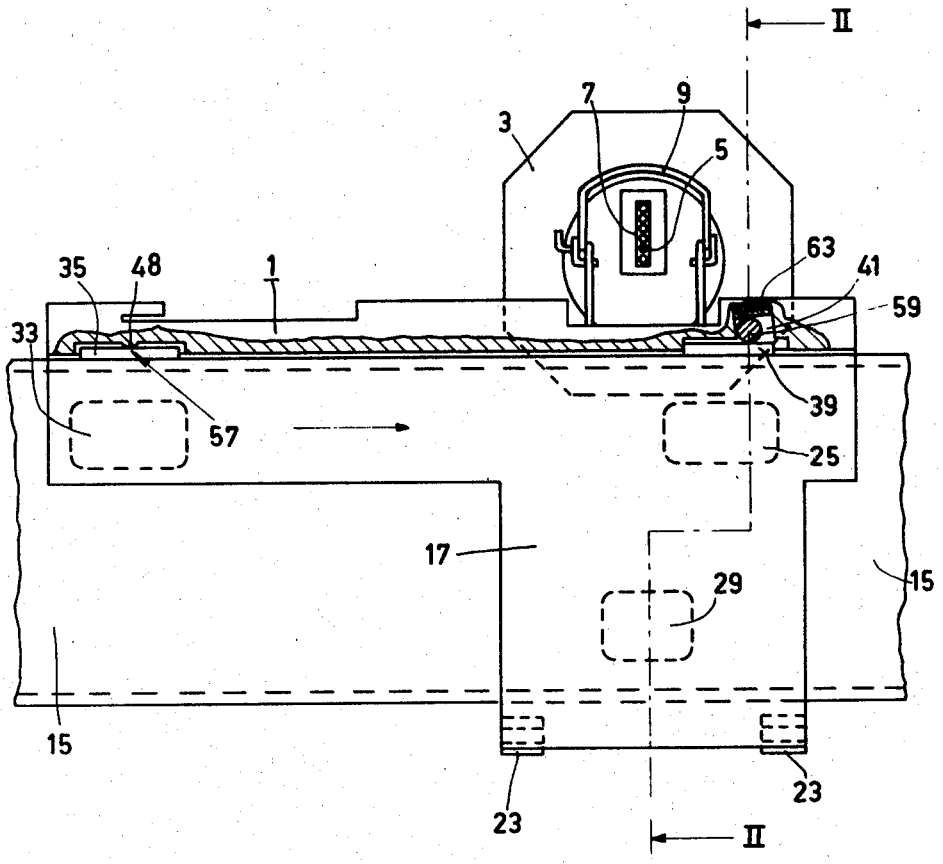
FIG. 1 is a partial sectional front view of a matrix printer in accordance with the invention.
Figure 2:
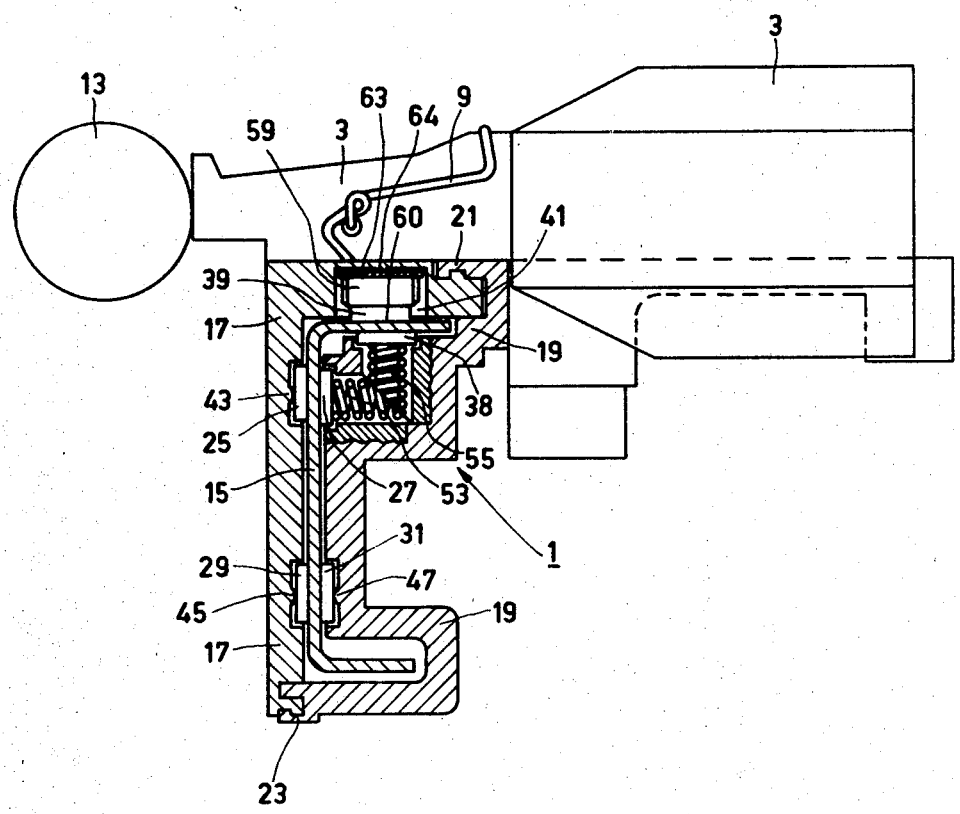
FIG. 2 is a side elevation and a sectional view, taken along the line II—II, of the matrix printer shown in FIG. 1.
Figure 3:
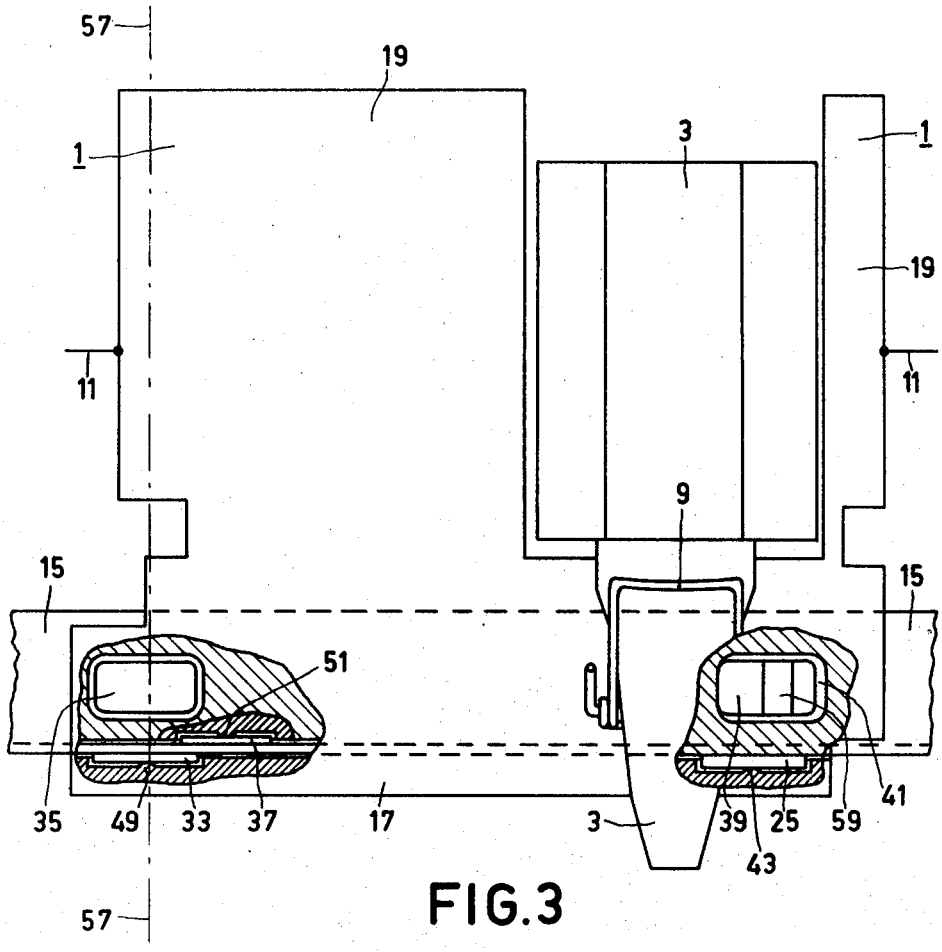
FIG. 3 is a plan view of the matrix printer shown in FIG. 1.

The matrix printer shown in the FIGS. 1, 2 and 3 comprises a printing head 3 of a known type which is mounted on a carriage 1 and which comprises six printing styli which can be electromagnetically displaced and whose printing ends 5 are situated in a vertical line.

The printing styli are guided in a bearing 7 near their printing ends 5. The printing head 3 is secured on the carriage 1 by means of a known wire clamp 9. There is provided a motor-driven cable 11 for moving the carriage 1 to and fro along a paper guide 13 on a stationary guide profile 15 which extends parallel to the line direction. The guide profile 15 has a U-shaped section (see FIG. 2) and serves as a guide for the carriage 1 which consists of two snap-connected portions, that is to say a front portion 17 and a rear portion 19. The snap connections are provided at the area of the reference numerals 21 and 32 (FIGS. 1 and 2). Other, similar snap connections between the portions 17 and 19 of the carriage 1 have been omitted for the sake of simplicity.

The carriage 1 is guided along the guide profile 15 by means of a number of sliding plates 25, 27, 29, 31, 33, 35, 37, 38 and a friction plate 39. As will be explained hereinafter, the sliding plates 25–38 are subject to considerations concerning the friction other than the friction plate 39. The sliding plates 25–38 as well as the friction plate 39 are situated in chambers of the carriage 1. The chambers of the sliding plates 25–37 have not been denoted by reference numerals for the sake of simplicity. The friction plate 39 is situated in a chamber 41 of a special kind which will be described in detail hereinafter. All sliding plates 25–38 are arranged in the relevant chambers with a clearance in order to enable a small relative movement between the plates and the carriage 1. For the sake of said relative movement, the sliding plates 25, 29, 31, 35, 33 and 37 are also tiltable about semi-spherical cams 43, 45, 47, 48, 49 and 51, respectively, formed in the walls of the relevant chambers. The sliding plate 27 is retained against the guide profile 15 by means of a helical spring 53 (FIG. 2). This prevents so-called static over definition in a direction perpendicular to the line direction. For other reasons yet to be described, the sliding plate 38 is also retained against the guide profile 15 by way of a helical spring 55. The sliding plates 25–38 and the friction plate 39 provide the guiding of the carriage 1 on the guide profile 15. The carriage 1 is proportioned so that all around a clearance is present between the carriage and the guide profile 15.

Figure 4:
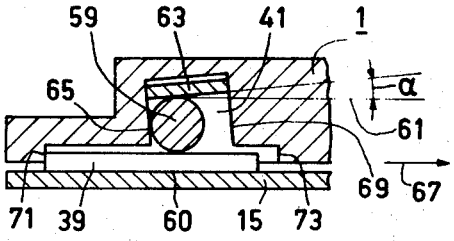
FIG. 4 shows, at an increased scale, the position changer used in the matrix printer shown in the FIGS. 1, 2 and 3.

The carriage 1 is pivotable about a horizontal axis 57 (see FIG. 3) which extends perpendicularly to the line direction. The pivot axis 57 extends through the point of contact between the cam 48 and the sliding plate 35, that is to say perpendicularly to the plane of the paper in FIG. 1. Therefore, together with the carriage 1 the printing head 3 is also pivotable about the pivot axis 57. The pivoting motion of the combination formed by the carriage 1 and the printing head 3 is realized by means of a position changer which is constructed as a circular-cylindrical roller 59 in the embodiment shown in the FIGS. 1, 2, 3 and 4, said roller being capable of rolling and/or sliding across the friction plate 39 which in its turn is capable of sliding on the guide profile 15. Like the friction plate 39, the roller 59 is present in the chamber 41 whose upper side 60 constitutes a boundary of the guide profile 15. The chamber 41 also accommodates a plate 63 which is arranged at an angle $\alpha$ with respect to the line direction 61 and which is pivotable about a rib 64 in the wall of the chamber 41 (FIG. 2). The roller 59 is capable of rolling and/or sliding across the surface of the plate 63 which faces the friction plate 39. The central axis of the roller 59 extends perpendicularly to the line direction. In the situation shown in FIG. 4, the roller 59 abuts against a first boundary wall 65 of the chamber 41, while the carriage 1 is being displaced on the guide profile 15 in the direction of the arrow 67. Opposite the first boundary wall 65 there is provided a parallel, second boundary wall 69. In the described circumstances, the friction plate 39 abuts against a third boundary wall 71, a fourth boundary wall 73 being situated opposite the third boundary wall 71.

Just before the carriage 1 reaches the point beyond the end of a printed line where a movement to the right is reversed into a movement to the left, the carriage 1 is strongly braked for a brief period of time. The masses of the friction plate 39 and the roller 59 and the frictional forces on the friction plate 39 and the roller 59 and also the force exerted on the roller 59 by the carriage 1 are proportioned so that the roller 59 abuts against the second boundary wall 69 before the friction plate 39 abuts against the fourth boundary wall 73. Because the distance between the roller 59 and the second boundary wall 69 is larger than the distance between the friction plate 39 and the fourth boundary wall 73, the roller 59 must already roll across the friction plate 39 for some time before sliding occurs between the friction plate 39 and the guide profile 15. This is achieved by choosing the friction coefficient between the friction plate 39 and the guide profile 15 to be comparatively high with respect to the friction coefficient between the roller 59 and the friction plate 39 as well as with respect to the friction coefficient between the roller 59 and the plate 63 or the first boundary wall 65 and the second boundary wall 69. The instant at which the roller 59 and the friction plate 39 abut may be before as well as after the instant of the movement reversal, depending on the value of the relevant mass inertia forces.

In an alternative embodiment the movement to the right can be decelerated over a comparatively long period of time. The roller 59 and the friction plate 39 then remain in contact with the boundary walls 65 and 71, respectively, until the instant at which the movement is reversed. It is only the movement to the left immediately after the reversal of the movement of the carriage that causes the changing of boundary wall. Such changing is possible, for example, if the distance between the friction plate 39 and the fourth boundary wall 73 is larger than approximately twice the distance between the roller 59 and the second boundary wall 69.

Due to the changing of the abutment of the roller 59 from the boundary wall 65 to the boundary wall 69, the carriage 1, together with the printing head 3, pivots about the pivot axis 57 through a given angle (see FIGS. 1 and 3). Due to this pivoting motion, the printing head 3 is lowered a distance of 0.09 mm in the present case. The horizontal displacement of the printing head due to the pivoting motion about the axis 57 is negligibly small, and hence also the resultant obliqueness of the printed characters, because the distance between the axis 57 and the roller 59 is comparatively large. After the lowering of the printing head 3 over a vertical distance of 0.09 mm, printing takes places from right to left between the character elements already printed on the same line during the movement from left to right. The vertical distance between these character elements amounted to 0.18 mm.

It is also to be noted that the printing head 3 may alternatively comprise several columns of printing styli. A customary type, for example, comprises two columns of printing styli. These two columns of printing styli may be staggered or not with respect to each other. In the case of staggered columns of printing styli, the vertical distance between the first printing stylus of the first column and the first printing stylus of the second column often amounts to 0.18 mm, while the vertical distance between two successive printing styli in the same column of printing styli amounts to 0.36 mm.

Upon the reversal of the movement at the end of the pass of the carriage from right to left, the carriage 1 with the printing head 3 is lifted over a distance which equals the distance over which the combination has been lowered upon the previous several movements. The roller 59 has already moved from the second boundary wall 69 to the first boundary wall 65 during the deceleration of the carriage 1. The roller 59 abuts against the boundary wall 65 before the friction plate 39 abuts against the third boundary wall 71. The instant of abutment may be before as well as after the instant of movement reversal, depending on the value of the mass inertia forces on the roller 59 and the friction plate 39. When the movement reversal is used to cover the remaining distance between the roller 59 and the boundary wall 65, therefore, the mass inertia effect may never be so large that the roller 59 abuts before the movement reversal.

Like for the movement reversal at the right-hand side, the deceleration of the carriage can again be realized over a comparatively long period of time upon movement reversal at the left-hand side. The changing of boundary wall is completely realized directly after the movement reversal on the left-hand side in this alternative embodiment.

Figure 5:
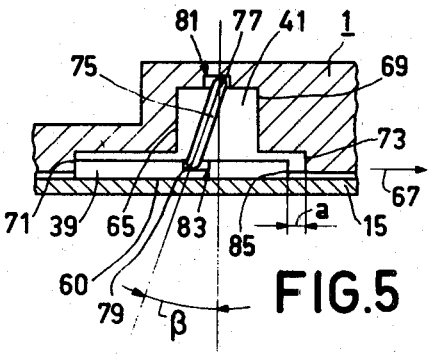
FIG. 5 shows, at an increased scale, an alternative position changer which can be used in a matrix printer in accordance with the invention.

The alternative position changer shown in FIG. 5 consists of a rod 75 having rounded ends 77 and 79. The rod 75 constitutes the coupling between the carriage 1 and the friction plate 39. To this end, the carriage 1 and the friction plate 39 are provided with bearing races 81 and 83. In the situation shown in FIG. 5, the distance a between the end 85 of the friction plate 39 and the fourth boundary wall 73 of the chamber 41 is so large that, after the reversal of the movement direction of the carriage 1 which is denoted by the arrow 67, the bearing race 83 is situated below the bearing pot 81, viewed in the vertical direction, the pivot rod 75 being in the vertical position. In the embodiment shown in FIG. 5, therefore, the friction plate 39 not only acts as a sliding element having an accurately defined friction behavior, but also as a stop for the pivot angle $\beta$ of the pivot rod 75. The changing of the boundary wall by the friction plate 39 can again takes place exclusively by the movement reversal or by a combination of the effect of the mass inertia force, exerted on the friction plate 39 and the rod 75 when the carriage 1 is decelerated, and the movement reversal. The complete changing of the boundary wall can even take place before the instant of movement reversal if the deceleration of the carriage 1 takes place within a sufficiently short period of time. When the pivot rod 75 is pivoted through the angle $\beta$ from the position shown in FIG. 5, the combination of the carriage 1 and the printing head 3 is pivoted counterclockwise about the pivot axis 57 through such an angle that said combination is again lifted over 0.09 mm in the vertical direction. The displacement of the combination in the horizontal direction is negligibly small due to the comparatively large distance between the pivot axis 57 and the bearing race 81.

It is to be noted that the pivot angle $\beta$ of the pivot rod 75 can alternatively be determined in a direct manner instead of indirectly by the stroke which can be performed by the friction plate 39 with respect to the carriage 1. The first boundary wall 65 and the second boundary wall 69 then comprise oppositely situated abutments for the pivot rod.

Even though the chamber 41 is situated completely within the carriage 1 in the described embodiment of the matrix printer, it is alternatively possible to use a chamber which is situated partly within the carriage 1 and partly within the printing head 3. The friction plate 39 is then situated within the carriage 1, while the oblique plate 63 is situated within the printing head 3. Height adjustment is then realized by relative displacement of the printing head 3 with respect to the carriage 1.

It is also to be noted that the printing head 3 may comprise different types of printing elements which are suitable for matrix printing. For example, the printing elements may consist of electrodes for electrostatic printing or ink tubes which apply droplets of ink to the record carrier.

Finally, it is to be noted that position changers can also be used on either side of the printing head. The pivot axis 57 can then be dispensed with. An embodiment of this kind has the advantage that the construction of the carriage 1 may be narrower.

What is claimed is:

1. A matrix printer having a combination of a carriage and a printing head which is mounted thereon, said combination being movable to and fro along a paper guide, said printing head having a first printing position for printing character elements during a pass from left to right and a second printing position for printing character elements during a pass from right to left, the character elements of a given printing element in the printing head printed on the paper during the movement of the printing head to the right being displaced over a distance which amounts to a part of the vertical distance between two successive printing elements in the printing head with respect to the character elements of the same printing element which are printed on the paper during the movement to the left, characterized in that:

a chamber is formed by the combination of said carriage and said printing head;

a position changer is located within said chamber; and said printer further includes:

means to displace said position changer relative to said combination by a variation of the impulse of movement of the printing head, the printing head being in one printing position before said inpulse variation and in another printing position after said impulse variation.

2. A matrix printer as claimed in claim 1, characterized in that the position changer constitutes the coupling between the printing head and a friction plate which is slidable on a guide wall which bounds the chamber.

3. A matrix printer as claimed in claim 2, characterized in that the position changer is a circular cylinder which is rollable on the friction plate and a surface which is oppositely situated in the chamber at an angle with respect to the line direction and the friction plate, said cylinder abutting against a first boundary wall of the chamber in a first printing position and against a second boundary wall of the chamber, opposite the first boundary wall, in the second printing position, the two boundary walls and the central axis of the circular cylinder being parallel to one another.

4. A matrix printer as claimed in claim 2, characterized in that the position changer is a pivot rod, one end of which is journalled in the carriage while its other end is journalled in the friction plate, the pivot angle of the pivot rod being determined by abutments for the friction plate which are situated within the chamber.

5. A matrix printer as claimed in claim 1, characterized in that the chamber is provided within the carriage, the guide wall bounding the chamber forming part of a stationary guide profile which extends parallel to the line direction, the printing head and the carriage being pivotable with the respect to the guide profile from the first printing position to the second printing position and vice versa about a pivot axis which extends perpendicularly to the line direction.

* * * * *